United States Patent [19]

Uke

[11] Patent Number: 4,531,178

[45] Date of Patent: Jul. 23, 1985

[54] DIVER'S FLASHLIGHT

[76] Inventor: Alan K. Uke, 247, S. Rios, Solana Beach, Calif. 92075

[21] Appl. No.: 571,501

[22] Filed: Jan. 17, 1984

Related U.S. Application Data

[63] Continuation-in-part of Ser. No. 292,897, Aug. 14, 1981, abandoned.

[51] Int. Cl.[3] ..... F21L 7/00

[52] U.S. Cl. ..... 362/158; 362/183; 362/186; 362/202; 362/203; 362/205; 362/295; 200/60

[58] Field of Search ..... 362/158, 183, 186, 202, 362/203, 205, 295; 200/60

[56] References Cited

U.S. PATENT DOCUMENTS

| | | | |
|---|---|---|---|
| 2,366,929 | 1/1945 | Pfeil | 362/158 X |
| 4,109,405 | 8/1978 | Ito | 362/158 X |
| 4,114,187 | 9/1978 | Uke | 362/158 |
| 4,144,557 | 3/1979 | Kerr et al. | 362/158 X |
| 4,234,913 | 11/1980 | Ramme | 362/158 |
| 4,429,351 | 1/1984 | Petzl et al. | 362/205 X |

*Primary Examiner*—Stephen J. Lechert, Jr.
*Attorney, Agent, or Firm*—Fulwider, Patton, Rieber, Lee & Utecht

[57] ABSTRACT

A diver's flashlight having a unitary case with a closed end and with a battery pack in said case seated against a spring. A connector strip is positioned in the case and provides spaced-apart contactor portions at opposite ends of the case. A removable barrel is in watertight threaded engagement with the case and is positioned over a reflector block with a halogen lamp mounted in a reflector in the reflector block. Threading the barrel onto the case overcomes the spring pressure and completes the circuit between the bulb and the battery pack through the connector strip to switch the flashlight on and off. A battery charging unit incorporates a removable charging head which replaces the reflector block and barrel for in-place charging of the battery pack of the flashlight. In a second embodiment the lamp is adjustably mounted in the reflector block permitting selective positioning of the lamp with respect to the reflector to focus the flashlight beam in conjunction with the switch operation.

13 Claims, 10 Drawing Figures

DIVER'S FLASHLIGHT

REFERENCE TO RELATED APPLICATIONS

This application is a continuation-in-part of my copending application Ser. No. 292,897 filed Aug. 14, 1981, now abandoned.

BACKGROUND OF THE INVENTION

The usual reduced visibility encountered underwater requires a source of light if a diver is to perform useful work. Because of the breathing equipment worn and protective clothing often required by a diver, his mobility and manual dexterity are severely reduced. These factors necessitate that the light source be rugged and simple to use. Finally, the electrical conductivity and pressure of the diver's water environment require exceptional watertight integrity to permit operation of a light source underwater. An underwater flashlight is capable of providing the necessary illumination under most circumstances provided that it is rugged and easy to carry, versatile in producing an appropriate beam pattern, and has secure watertight integrity including the switching arrangement. Since diving operations are often conducted at remote sites, far from sources of supply, it is desirable that a flashlight for divers be easy to repair and rechargeable from a generally available electrical power source.

Constructions for divers' flashlights have been provided using waterproof covers with control switches operated through seals. However, such seals wear and leak after a period of use. Parts removable from the flashlight, and openings in the flashlight such as battery charging connections must be sealed. The latter requirement poses problems servicing a diver's flashlight since the seals are often damaged or destroyed in use and are difficult to remake. Applicant's invention provides the operational features and characteristics desired in an underwater flashlight while at the same time eliminating or minimizing the noted hazards in providing a diver's flashlight capable of continued effective use and easy servicing.

SUMMARY OF THE INVENTION

The diver's flashlight described herein provides a strong focusable light beam while overcoming the problems of prior devices. It includes an elongated cylindrical casing having one closed end and one open end. A connector strip is positioned in the side wall of the casing and includes a first contactor portion adjacent the closed end and a second contactor portion adjacent the open end of the casing. A spring in the casing urges a battery pack toward the open end of the casing. A cylindrical barrel having a light window at one end is in threaded watertight engagement with the open end of the casing. The barrel houses a reflector block which is urged by the spring against the window. The reflector block includes a halogen bulb and a faceted reflecting surface. The bulb is energized when the barrel is threaded into position on the casing, and the bulb circuit is completed with the battery pack through the connector strip. The barrel action thus performs as the flashlight switch as well as sealing the open end of the casing.

A battery charging unit includes a charging head which replaces the barrel and cooperates with of the connector strip to connect a battery charger to the battery pack for charging the battery in the flashlight casing.

A second embodiment of the invention provides for focusing the flashlight beam and insures alignment of the reflector block within the barrel. A resilient washer spaced between the reflector block and a conduction cap permits adjustment of the bulb position with respect to the reflector to focus the beam in conjunction with the barrel's sealing and switching function. Alignment studs formed on the casing edge function in conjunction with a contactor portion of the strip to engage a conduction cap to prevent misalignment of the reflector block when the bulb is being turned on or off.

It is an object of the present invention to provide a new and improved diver's flashlight which is simple in construction and relatively inexpensive to manufacture. The flashlight disclosed is easy to use and is effective in operation while eliminating leakage problems. It is another object of the present invention to provide a diver's flashlight which produces an even, coherent beam. Other objects and many attendant advantages of the invention will become more apparent upon reading the following detailed description, together with the drawings, in which like numbers refer to like part throughout and in which:

DETAILED DESCRIPTION OF THE INVENTION

Figures 1, 2, 3, 4, 5:
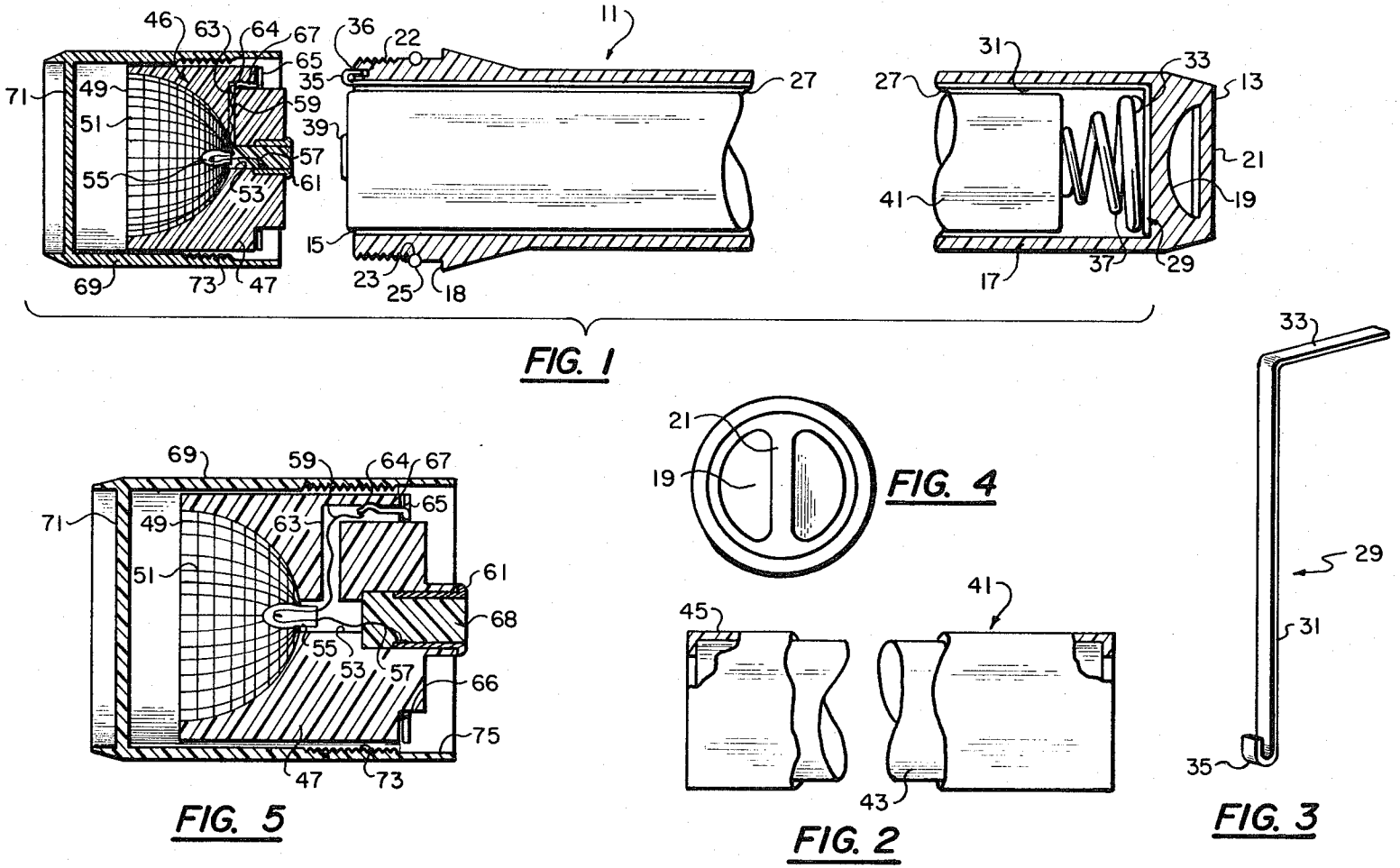
FIG. 1 is a longitudinal sectional view of a diver's flashlight constructed in accordance with the present invention.
FIG. 2 is a side elevation of a battery pack partially sectioned to show internal construction.
FIG. 3 is a perspective view showing the connector strip used in the diver's flashlight shown in FIG. 1.
FIG. 4 is a rear elevation of the diver's flashlight of FIG. 1 showing the means for attaching a lanyard to the case.
FIG. 5 is an enlarged view of the front portion of the diver's flashlight as shown in FIG. 1.

Referring to FIG. 1 of the drawings, the flashlight includes an elongated cylindrical casing 11 which is closed at end 13 and open at end 15. The casing 11 is preferably made in one piece from a tough plastic material such as Lexan. A flange 18 is formed near the open end of the casing. The casing includes ribs 17 to provide a good gripping surface. The casing may be transparent.

As depicted in FIGS. 1 and 4, the closed end 13 of the casing has a concave recessed portion 19 with a cross member 21 formed therein. A lanyard can be easily affixed to the cross member to prevent the flashlight from being dropped or lost. The cross member is contained within the recess 19 so that it does not protrude and risk the chance of being knocked off, while the concave configuration of the recessed portion 19 facilitates threading the end of a lanyard under the cross member 21.

Referring to FIGS. 1 and 3, external screw threads 22 are formed adjacent the open end 15 of the casing 11. An annular groove 23 is formed in the casing adjacent the threads 22 and seats a resilient sealing ring 25. The casing 11 includes an elongated internal groove 27 extending from its open end to its closed end. A connector strip 29 of electrically conductive material is disposed with its strip portion 31 in slot 27. A leg 33 extends at substantially a right angle to the strip portion 31 adjacent the closed end of the casing 11 when the connector strip 29 is inserted into the open end of the casing. A substantially U-shaped contactor portion 35 is formed on the opposite end of the strip portion 31 from the leg 33. As the connector strip 29 is inserted in place in groove 27, the contactor portion 35 seats in an opening 36 in the edge of the open end of the casing 11, and the leg 33 is positioned adjacent the closed end of the casing. The contactor portion 35 fits snugly into place in the opening 36 and extends outward a slight distance from the open end of the casing.

A spring 37 is inserted through the open end of the casing 11 against the leg 33 on the connector strip 29. As illustrated in FIGS. 1 and 2, a battery pack 41 is provided which includes a suitable number of rechargeable batteries 43 connected together in the usual manner and enclosed in an insulating jacket 45. The battery pack 41 is inserted into the casing 11 through the open end 15, and the bottom of the battery pack makes contact with spring 37.

A lamp unit 46 is formed of a cylindrical reflector block 47 of high temperature plastic material such as glass filled polyester. The block 47 includes a reflectively-coated cavity 49 of substantially parabolic configuration. This cavity includes facets 51 which increase in size as they extend toward the outer end of the cavity. It has been found that this type of faceted configuration permits the cavity 49 to have less curvature and evens out the light beam.

As depicted in FIGS. 1 and 5, the reflector block 47 also contains an axial bore 53 in which a bulb 55 is positioned in focal relationship to the reflector cavity 49. The bulb shown in the drawings is a halogen type for maximum brightness. The high temperature plastic block 47 acts as a heat sink for the halogen bulb. The bulb 55 has a pair of connecting wires 57 and 59. The wire 57 is located by and connected to a conductive rivet 61 with a hollow core 68 which is press fitted into bore 53 forming a conductive post. The conductive rivet 61 extends from the back of the block 47 into the open end 15 of the casing 11 to contact terminal 39 of the battery pack 41. The wire 59 extends through a slot 63 spaced from bore 53, and is affixed in such slot by suitable means such as an adhesive, A ring 65 is positioned over the shoulder 66 of block 47 and has a finger 67 extending into the slot 63 with a boss 64 adjacent its free end to retain the finger in position in contact with wire 59 when it is inserted into the slot 63.

A window barrel 69 is provided that includes a closed end having a transparent window 71 and that is open at the opposite end. The window barrel has internal threads 73 which engage the threads 22 on casing 11. The internal bore 75 is smooth and forms a sealing engagement with the sealing ring 25 when the window barrel is threaded on the casing 11.

As illustrated in FIG. 1, the battery pack 41 is urged to protrude a small amount from the open end 15 of the casing 11 by spring 37. The block 47 seats against the closed end of the barrel 69, and as the barrel is first threaded onto the casing, the battery pack 41 is urged against the rivet 61 by the spring 37 as the spring is compressed. However, the contactor portion 35 of the connector strip 29 remains spaced from the ring 65 and the flashlight is in the "off" position. The bore portion 75 extends over the sealing ring 25 so that no water can leak in. As the barrel 69 is threaded further on to the casing against the spring pressure, the ring 65 makes contact with the contactor portion 35 of connector strip 29 just prior to the point at which the end of the barrel seats against flange 18. A fraction of a turn of the barrel then engages the end of the barrel with the flange to provide a positive seat in the "on" position of the flashlight. The sealing ring 25 is well within the bore 75 in both the "on" and "off" positions so that water does not seep into the interior portion of the flashlight. No metal parts are exposed to moisture and corrosion is avoided since the only opening into the casing 11 is sealed by the sealing ring 25.

Figure 6:
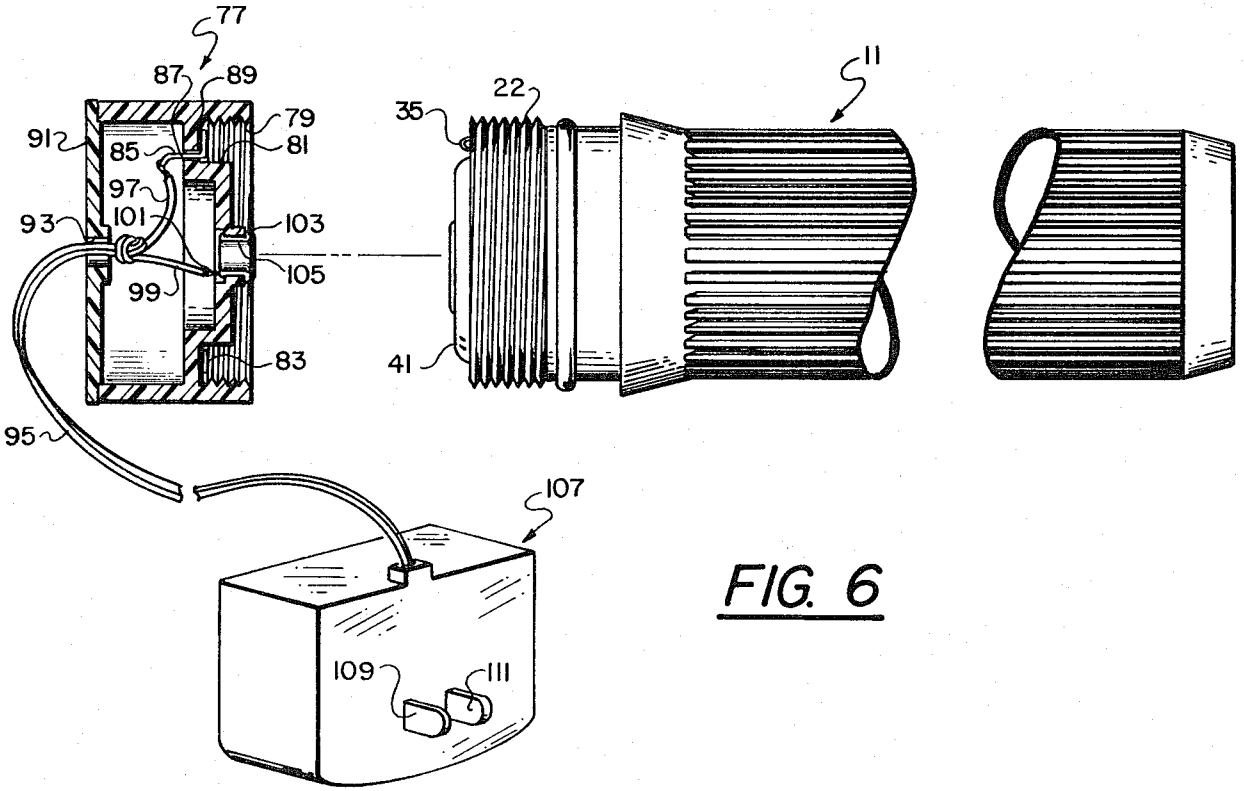
FIG. 6 is a view of the battery charging unit and charging head employed with the diver's flashlight depicted in FIG. 1.

A battery charging head 77 and charger 107 for recharging the battery pack 41 in place within the flashlight case 11 is illustrated in FIG. 6. The charging head 77 incorporates a cap 91 having internal threads 79 which mate with the external threads 22 of the flashlight case 11 allowing the cap 91 to replace the flashlight barrel 69 (FIG. 1). The cap has an internal wall 89 with a raised cylindrical shoulder 81. An electrically conductive ring 83 surrounds and is supported by shoulder 81 and rests against the wall 89. The ring is provided with a finger connector 85 which passes through an opening 87 in the wall 89 and projects into interior of the cap 91. A charging rivet 105 forming a charging post is positioned in a cylindrical opening 103 in the center of the shoulder 81 and is provided with a solder lug 101.

The charger 107 obtains power from a conventional electrical outlet, not shown, employing prongs 109 and 111 to make the connection. A two wire conductor cord 95 carries the electrical output of the charger 107 to the charging head 77, entering the cap 91 via the opening 93. Wire 99 of the cord is soldered to the charging post lug 101. The charging rivet 105 extends beyond the shoulder 81 and engages the positive terminal of the battery pack 41 when the cap 91 is threaded on the case 11. The second wire 97 of the cord 95 is soldered to the finger 85 of the ring 83. Thus, the output potential of the charger 107 is available between the ring 83 and the charging rivet 105. With this design, the battery pack 41 may be simply and easily recharged in place using the circuit components of the flashlight when the charging head 77 is threaded upon the end of the case 11. The ring 83 makes electrical contact with the contactor 35 and one battery terminal, while the charging rivet 105 completes the circuit by being in contact with the opposite terminal of the battery pack.

Figure 7:
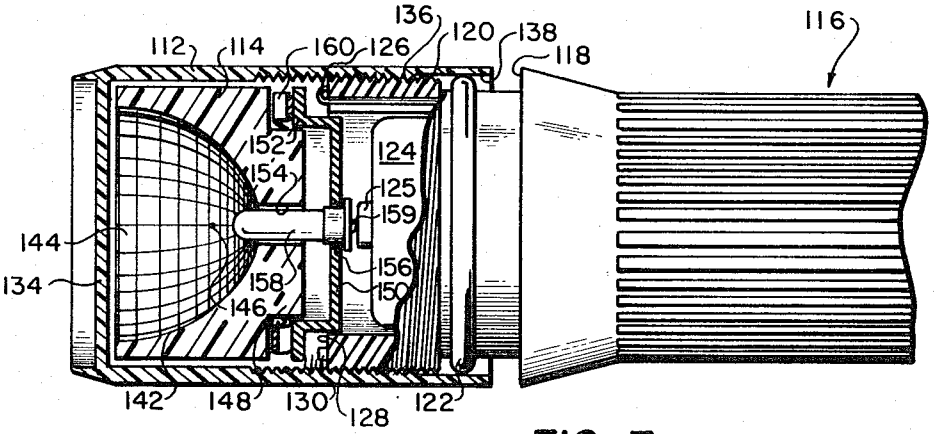
FIG. 7 is a sectional view of a second embodiment of the diver's flashlight illustrating the light beam focusing and reflector block alignment design.
Figure 9:
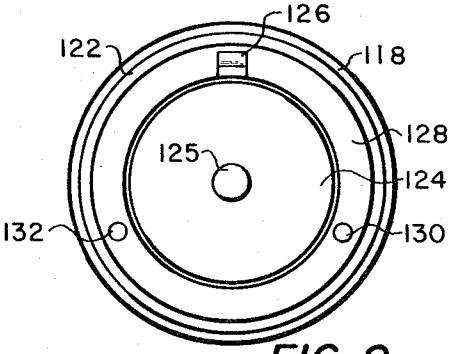
FIG. 9 is a front elevation view of the flashlight casing of FIG. 7 further depicting the reflector block alignment structure.

A second embodiment of the invention incorporating lamp focusing and alignment features is illustrated in FIG. 7 wherein the flashlight barrel 112, containing a lamp reflector block 114, is depicted being threaded upon the flashlight casing 116. The configuration of the casing 116 and the elements of the flashlight contained therein are the same as in the first embodiment except as will be subsequently described. The casing flange 118, threaded portion 120, and sealing ring 122 are the same, and perform the same functions as described previously for the first embodiment of FIG. 1. The arrangement and function of the battery pack 124 having a positive terminal 125, and connector strip contactor portion 126 projecting from an opening in edge 128 of the casing 116 are also the same as previously described. As illustrated in FIGS. 7 and 9, the casing 116 has studs 130 and 132 formed on the casing edge 128 which are arranged circumferentially along the edge and spaced equally from the connector 126. The studs 130 and 132 have a height above the surface of casing edge 128 equal to the projection of the connector 126 from that surface. The spacing and height of the studs 130 and 132 function in conjunction with contactor 126 to establish an engagement plane for maintaining the alignment of the reflector block 114 when the barrel 112 is threaded upon the flashlight case 116.

Figure 8:
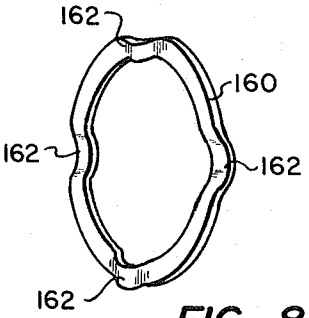
FIG. 8 is a perspective view of the resilient washer for selectively positioning the lamp in the embodiment of FIG. 7.

The barrel 112 of the second embodiment has an end window 134, internal threads 136, and a smooth internal bore portion 138 as previously described in connection with the embodiment of FIG. 1. The reflector block 114 is housed within the barrel 112 and has a substantially parabolic reflector cavity surface 142 formed therein. Facets 144 on the reflector surface 142 serve to form an even beam with less parabolic curvature. The focal point of the reflector surface 142 is represented by the point 146. The reflector block 114 is formed with an annular shoulder portion 148 at the end opposite the reflector. A conducting cap 150 fits slidably over the shoulder portion 148 and has a rim 152 for providing an electrical contact surface for the cap 150. The shoulder portion 148 of the block 114 and the cap 150 have in-line cylindrical apertures 154 and 156 respectively. A socket-type halogen bulb 158 is mounted in the cap aperture 156 with a friction fit. The bulb 158 extends through the aperture 154 into the reflector cavity toward the focal point 146. The positive terminal 159 of the bulb is aligned with terminal 125 of the battery pack. An annular resilient washer 160 is interposed between the cap rim 152 and the reflector block 114. The compressible undulations 162 of the washer 160, depicted in FIG. 8, provide spring action tending to hold the cap 150 away from the reflector block 114. The spring action, in conjunction with the slideably fit of cap 150 on the block 114, provides for longitudinal movement of the bulb toward and away from the focal point 146 of the reflector cavity.

Figure 10:
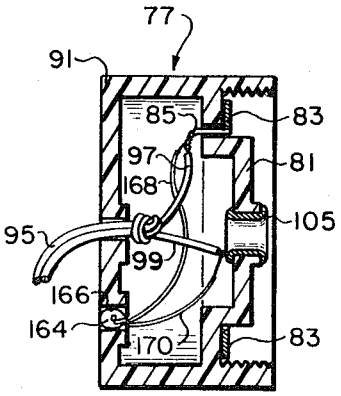
FIG. 10 is a sectional view of a modified battery charging head incorporating a charging indicator bulb.

A second embodiment of the battery charging unit head 77 is illustrated in FIG. 10. To provide visual indication of the charging of the battery pack 41, an indicator bulb 164 is installed in an aperture 166 in the base of the charging head cap 91. Electrical leads 168 and 170 are connected to the finger 85 and solder lug 101 respectively. The electrical potential to illuminate the bulb 164 is supplied via the leads 168 and 170 when the charging head 77 is threaded upon the case 11 as indicated in FIG. 6, and electrical power is supplied.

OPERATION

The operation of the diver's flashlight of the present invention will be described first with reference to FIGS. 1, 5, and 6. The flashlight casing 11 is sealed against water leakage by threading the barrel 69 upon the casing 11. The seal is effected by the engagement of the seal ring 25 with the smooth bore 75 of the barrel. When the barrel is installed, the spring 37 urges the positive terminal of the battery pack against the conductive rivet 61 connected to the lamp 55. This action in turn urges the lamp block 47 against the barrel window 71. Although sealed and ready for use, the flashlight beam is not initiated until further threading of the barrel upon the case brings the contactor portion 35 of the connector strip 29 in contact with the ring 65. This occurs just prior to the barrel 69 coming to rest against the flange 18 on the battery casing. Unthreading the barrel breaks electrical contact. Thus the position of the barrel 69 upon the casing 11 provides a watertight switching design for the flashlight.

When the flashlight battery pack 41 requires recharging, the barrel 69 is replaced on the casing 11 by the charging head 77 (FIG. 6) and the head 77 is connected to a source of power via the charger 107 and the two-wire lead 95. When charging, the contactor portion 35 of the connector strip 29 is forced into contact with the charging conductive ring 83 to complete the charging circuit to the battery pack.

A second embodiment of the charging head 77 is illustrated in FIG. 10. In this embodiment the bulb 164 mounted in the cap 91 is connected in parallel across the charging connections so as to be energized during charging and thus indicate the condition. When the battery pack charge has been completed, the charging head 77 is removed and the barrel 69 is reinstalled on the flashlight casing 11.

To operate the embodiment of the flashlight illustrated in FIG. 7, the barrel 112 is threaded upon the casing 116 in the same manner as previously described. In this embodiment, however, the bulb 158 is a socket-type and its mounting incorporates the light beam focusing feature. The bulb is energized by the battery pack electrical potential being applied to the bulb when the connector portion 126 is urged into contact with the conductive cap rim 152 by the barrel 112 being threaded upon the casing 116. When the latter contact is first made, the bulb 158 is energized, but the filament is not positioned at the focal point 146 of the reflector. As a result, a diffused light beam is formed by the flashlight. Further threading of the barrel upon the casing so as to engage the casing flange 118 compresses the resilient washer and positions the lamp filament at the focal point 146 of the reflector to produce a parallel uniform flashlight beam. Thus, in this embodiment, the barrel action performs a beam focusing function as well as a switching and sealing function.

Having described my invention, I claim:

1. A diver's flashlight suitable for underwater use comprising:

(a) a hollow, substantially cylindrical casing having an open end and a closed end and adapted to receive a battery pack comprising one or more batteries;

(b) a hollow, substantially cylindrical barrel having a transparent window at one end and having an open end at the other end thereof which is adapted to telescopically interfit with the open end of the casing;

(c) a reflector means position within the barrel having a central aperture therein adapted to receive a light bulb;

(d) manually operable means to connect the open ends of the casing and the barrel in a telescoped position which allows relative movement between the casing and the barrel along the longitudinal axis thereof;

(e) sealing means between the telescoped surfaces of the casing and the barrel to prevent the penetration of water into the interior of the flashlight when the flashlight is used underwater; and (f) means to electrically connect and disconnect the terminals of the battery pack with the light bulb when the casing and barrel are telescopically moved toward and away from each other along the longitudinal axis thereof.

2. A diver's flashlight according to claim 1, further comprising:

battery charging means including a charging head connectable on said casing in lieu of said barrel in cooperative operational relationship with said battery and a switch means for charging said battery pack in place within said casing.

3. A diver's flashlight according to claim 2, wherein: said charging means includes means for indicating when said battery is being charged.

4. A diver's flashlight according to claim 1, wherein: said reflector means includes a reflector block having a substantially parabolic reflective surface with a plurality of facets.

5. A diver's flashlight according to claim 4, wherein: said facets are progressively larger toward the outside of said reflective surface.

6. A diver's flashlight in accordance with claim 1 further comprising:

means for aligning said reflector means within said barrel when said barrel is attached to said casing by said connection means.

7. A diver's flashlight according to claim 4 wherein said bulb is a halogen bulb and said reflector block is high temperature plastic forming a heat sink for the heat generated by said halogen bulb.

8. A diver's flashlight according to claim 1 wherein: the outside of the closed end of said casing has a recess formed therein, a fastening member is provided within said recess for fastening a lanyard to said casing, and said recess is concave under said fastening member for facilitating the threading of a lanyard about said fastening member.

9. The diver's flashlight of claim 1 wherein the telescoped sections of the casing and barrel are threadably connected and movement along the longitudinal axis thereof is effected by rotating the casing or the barrel with respect to the other.

10. The diver's flashlight of claim 1 wherein an electrical conducting collar is provided between the battery pack and the light bulb to effect electrical contact therebetween.

11. The diver's flashlight of claim 10 wherein an L-shaped electrical conducting connector strip is provided within the casing which is adapted to electrically connect one terminal of the battery pack with electrical conducting collar to effect electrical contact between the battery pack and the bulb.

12. The diver's flashlight of claim 1 including means to position the light bulb along the longitudinal axis to focus the light beam therefrom.

13. The diver's flashlight of claim 1 wherein means to electrically connect and disconnect the battery pack with the light bulb includes an electrically conducting ring which is resiliently positioned on a shoulder provided on the reflector body.

* * * * *